US006648154B2

(12) United States Patent
Awalt

(10) Patent No.: US 6,648,154 B2
(45) Date of Patent: Nov. 18, 2003

(54) PRODUCE DISPLAY DEVICE

(75) Inventor: Terry Awalt, Lowell, ME (US)

(73) Assignee: JSI Store Fixtures, Inc., Milo, ME (US)

( * ) Notice: Subject to any disclaimer, the term of this patent is extended or adjusted under 35 U.S.C. 154(b) by 0 days.

(21) Appl. No.: 09/961,550

(22) Filed: Sep. 24, 2001

(65) Prior Publication Data

US 2003/0057169 A1 Mar. 27, 2003

(51) Int. Cl.[7] ..... A47F 7/00
(52) U.S. Cl. ..... 211/85.4; 211/85.18; 211/126.1
(58) Field of Search ..... 211/59.4, 126.1, 211/85.4, 60.1, 71.01, 85.18, 133.6, 59.2, 183, 49.1; 9/456; 206/534.1, 443, 446, 564, 521.1, 521.15, 521.2, 523, 524; D6/473

(56) References Cited

U.S. PATENT DOCUMENTS

D170,798 S * 11/1953 Dundon et al. ..... D58/13
D172,596 S * 7/1954 Harper ..... D58/13
D172,663 S * 7/1954 Despres ..... D58/13
D185,463 S * 6/1959 Reifers ..... D58/13
D205,735 S * 9/1966 Weiner
D212,411 S * 10/1968 Schelmetic ..... D9/187
D215,823 S * 11/1969 Bridgford ..... D9/99
4,182,455 A * 1/1980 Zurawin ..... 211/69.8
D259,010 S * 4/1981 Klatt ..... D6/157
4,339,039 A * 7/1982 Mykleby ..... 206/523
D274,441 S * 6/1984 Stevenson ..... D9/424
4,801,025 A * 1/1989 Flum et al. ..... 211/126.1
5,417,333 A * 5/1995 Flum ..... 211/194
5,456,359 A * 10/1995 Horn ..... 206/350
D370,177 S * 5/1996 Bankier ..... D9/424
5,555,671 A * 9/1996 Voight et al. ..... 206/315.11
D378,895 S * 4/1997 Bankier ..... D9/347
5,788,078 A * 8/1998 Fuss ..... 206/521
5,865,323 A * 2/1999 Lecroy ..... 211/183
6,135,297 A * 10/2000 DeShazo et al. ..... 211/189

* cited by examiner

*Primary Examiner*—Blair M. Johnson
*Assistant Examiner*—Jennifer E. Novosad
(74) *Attorney, Agent, or Firm*—Anthony D. Pellegrini, Esquire

(57) ABSTRACT

A one piece display stand for the point-of-sale display of produce, such as bananas, manufactured out of a closed cell foam material and of solid construction, with generally flat sides and bottom and a top surface having a number of concave troughs for holding the produce. The display stand is used in a retail setting by first being placed onto a table or other support structure, and then having produce placed within the concave troughs of the top surface. The troughs hold the produce in a visually pleasing manner, while the foam construction of the stand protects the produce from damage.

4 Claims, 7 Drawing Sheets

PRODUCE DISPLAY DEVICE

TECHNICAL FIELD

The invention relates generally to retail display devices for the point-of-sale display of produce and, more particularly, to a produce display stand known as a banana riser that is used to display bananas.

BACKGROUND

Produce display stands, and in particular banana risers, are well known in the industry. Conventional display stands are constructed of multiple components involving a labor-intensive manufacturing process. In addition, because of the multiple components, seams, joints, gaps, and other structures are of necessity utilized, providing access points to water, mold, and bacteria, which can damage the produce. The device claimed herein seeks to reduce these deficiencies.

SUMMARY

In one aspect, the invention is directed to a device for displaying produce, comprising a single-piece display member constructed of a closed cell foam material, such as closed cell pvc foam, with the top surface having a trough which supports produce.

This aspect may include one or more of the following features: the trough is concave and formed into the top surface; there are a plurality of troughs for supporting produce; the sides of the trough are parallel to each other; the inner surface of the trough is curved smoothly downward with the lowest point of the curve located midway between the edges of the trough; the trough extends laterally from the left surface to the right surface; the trough is parallel to each other trough; the trough has the same shape and dimensions as each other trough; the trough is shallow; the top and bottom surfaces of the display member are substantially parallel; the left and right surfaces are substantially parallel; the front and back surfaces are substantially parallel; each surface is substantially perpendicular to each other surface to which it is adjacent; the display member has a width of between forty inches and fifty inches, a depth of between forty inches and fifty-five inches, and a height of between four inches and six inches; and the trough has a width of between six inches and ten inches and a depth of between one and three quarter inches and three inches.

In another aspect, the invention is directed to a method of manufacturing a produce display device from closed cell foam material using compression molding technology. This method includes the creation of a mold which is comprised of a rectangular base member, four rectangular side members, and a rectangular top member, where the inner surfaces of the rectangular base and side members are flat and the inner surface of the rectangular top member has a convex trough pattern, and where the mold contains an aperture providing access into the interior of the mold; the creation of a liquid mixture of closed cell foam material; the insertion of the liquid mixture of closed cell foam material into the mold through the aperture; the heating and application of pressure to the liquid mixture of closed cell foam material within the mold causing the liquid mixture to expand and solidify and completely fill the mold; the removal of the solid closed cell foam material from the mold; and the cooling the solid closed cell foam material.

Other features and advantages of the invention are described below.

DESCRIPTION

Figure 1:
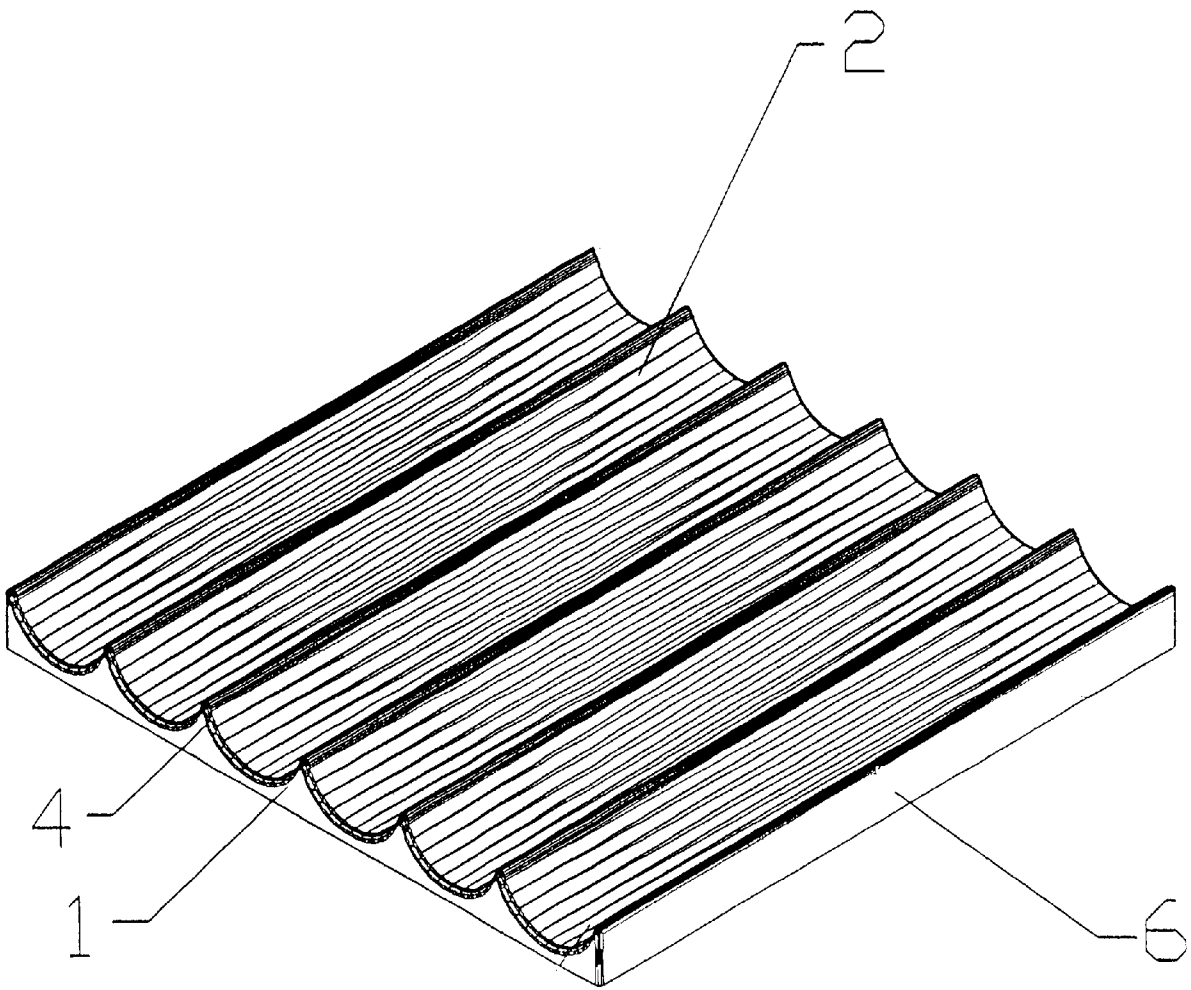
FIG. 1 is a perspective view of a banana riser, angled such that its top, front, and left sides are shown.
Figure 2:
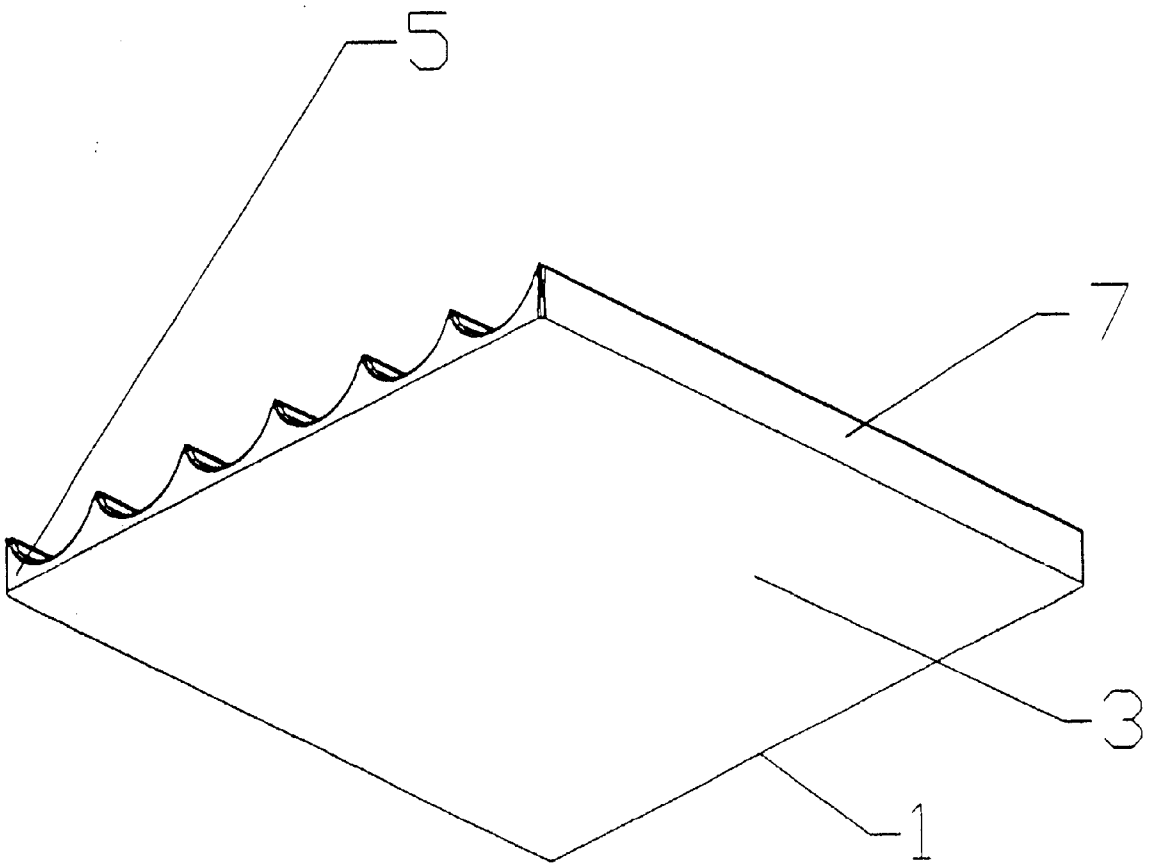
FIG. 2 is a perspective view of the banana riser, angled such that its bottom, back, and right sides are shown.
Figure 3:
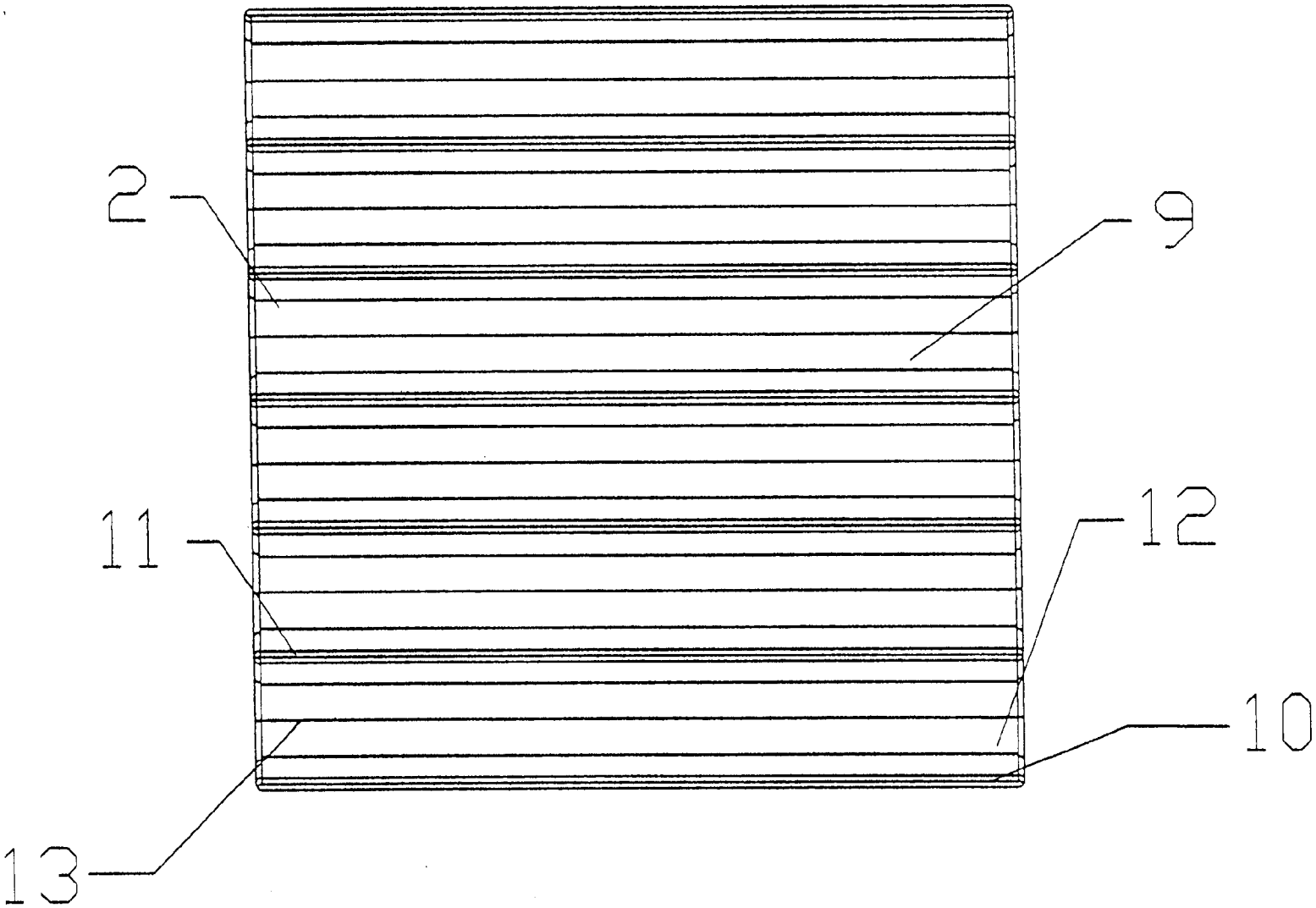
FIG. 3 is a top perspective view of the banana riser.
Figure 4:
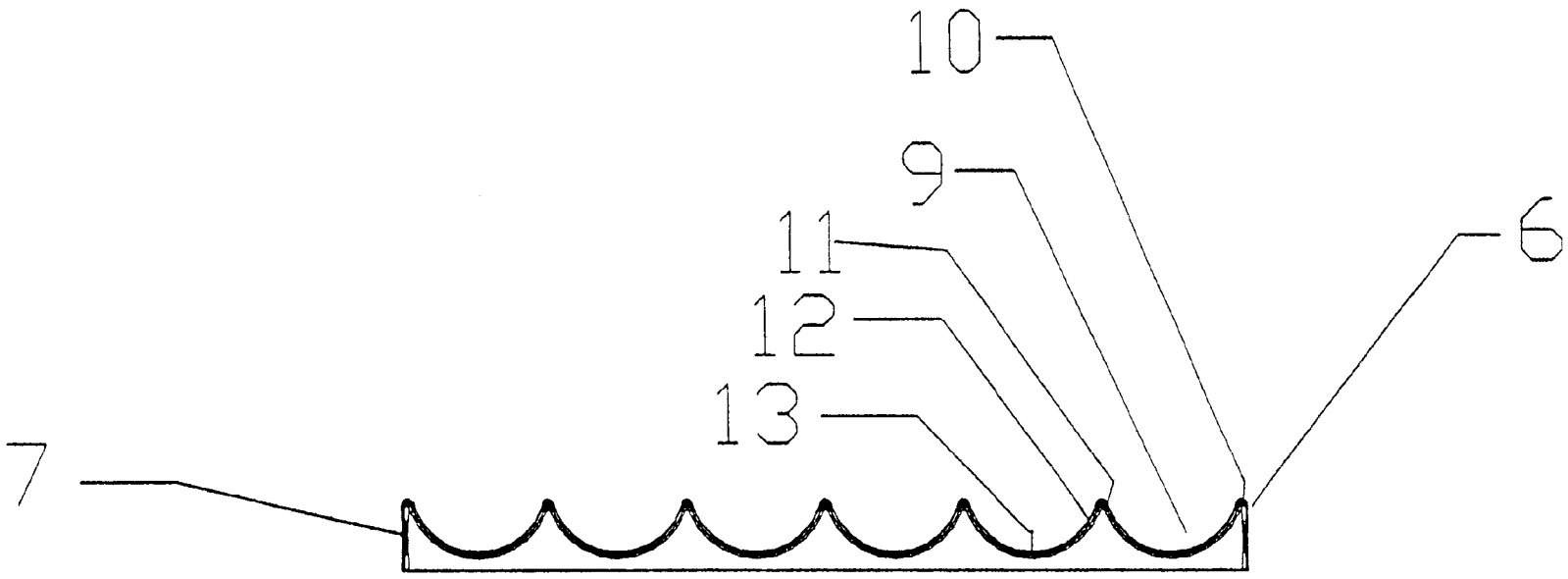
FIG. 4 is a side (left) perspective view of the banana riser.

FIGS. 1 through 4 show perspective views of one embodiment of a produce display stand, in this case a banana riser 1. Banana riser 1 includes concave troughs 9 and top surface 2. Produce is placed in concave troughs 9 formed into top surface 2. Inner curve 12 of troughs 9 holds the produce in place, thereby reducing the possibility that the produce will roll or slide off banana riser 1, while still allowing the produce to be visible and easily accessible. Banana riser 1 is manufactured using closed cell foam material, such as closed cell pvc foam. The foam construction cushions the produce and reduces bruising or other damage. Due to its foam construction, banana riser 1 is light weight, flexible, and fully immersible in water for easy cleaning and storage.

Concave troughs 9 are situated adjacent to each other across top surface 2. In this embodiment, each concave trough 9 runs laterally from left surface 4 to right surface 5 along the width of banana riser 1 and is situated adjacent to each other trough 9 from front 6 to back 7, is of uniform dimension, extends across the entire width of banana riser 1, has parallel edges 10, 11, has a substantially smooth curved inner surface 12, is substantially shallow (i.e., the depth of trough 9 is less than the distance between edges 10, 11), and is situated parallel to each other concave trough 9.

Banana riser 1 is formed with each of its side surfaces 4, 5, 6, 7 substantially perpendicular to bottom surface 3 and to the plane of top surface 2. Front surface 6 is substantially perpendicular to left 4 and right 5 surfaces. Back surface 7 is substantially perpendicular to left 4 and right 5 surfaces. Left surface 4 is substantially parallel to right surface 5. Front surface 6 is substantially parallel to back surface 7.

Banana riser 1 may be of varied size. In this embodiment, its dimensions are between forty inches (101.6 cm) and fifty inches (127 cm) wide, as measured from left surface 4 to right surface 5, between forty inches (101.6 cm) and fifty-five inches (139.7 cm) deep, as measured from front surface 6 to back surface 7, and between four inches (10.2 cm) and six inches (15.2 cm) high, as measured from bottom surface 3 to the highest point of top surface 2. The dimensions of each concave trough 9 may vary. In this embodiment, each concave trough 9 is between six inches (15.2 cm) and ten inches (25.4 cm) across, as measured in a straight line from each parallel edge 10, 11, and between one and three quarter inches (4.4 cm) and three inches (7.6 cm) deep, as measured from the top of trough 9 to its lowest point 13. The width of each concave trough 9 may be equal to the width of banana riser 1. The number of concave troughs 9 may vary. In this embodiment, there are six troughs 9 on each banana riser 1.

Figure 5:
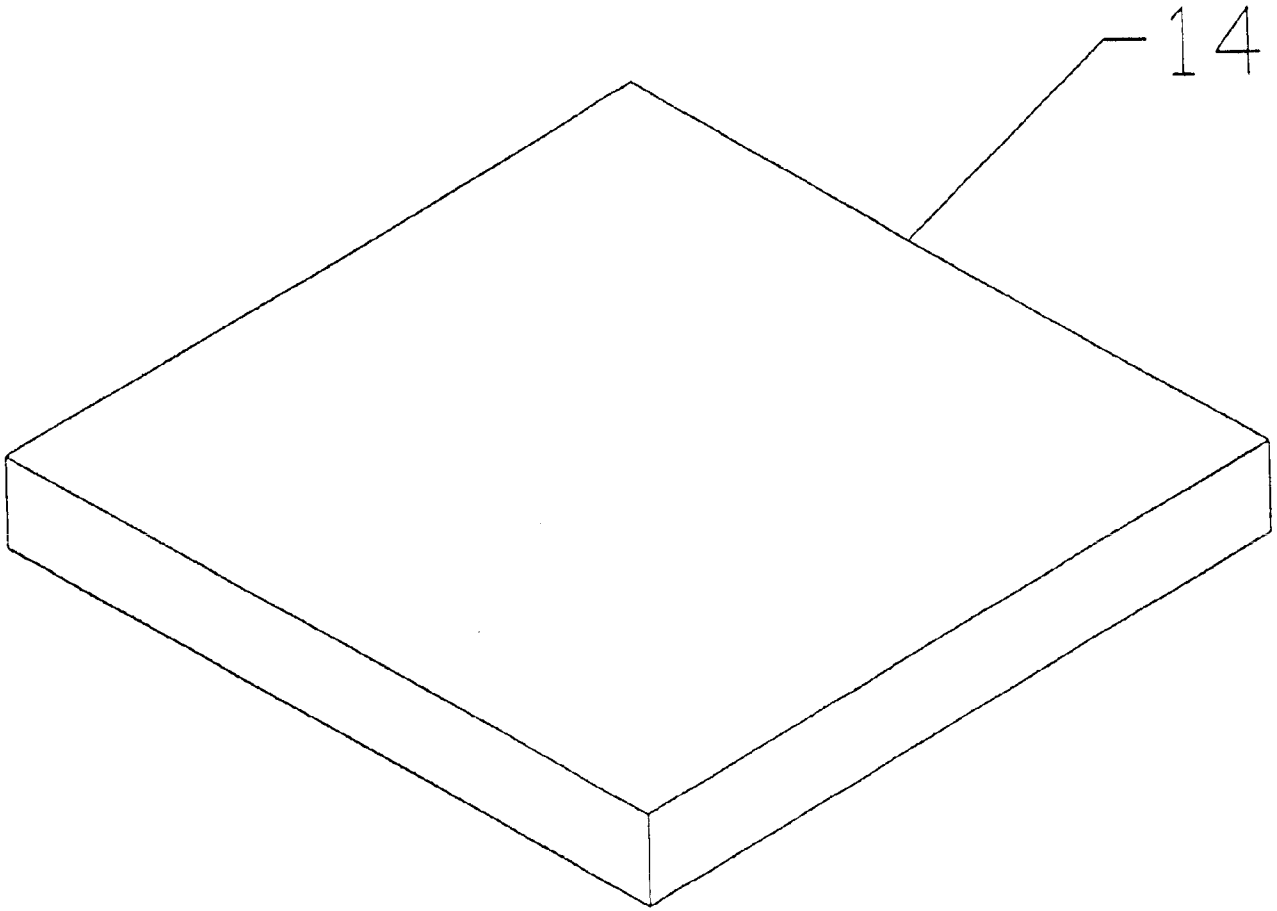
FIG. 5 is a perspective view of the mold used in compression molding to manufacture the banana riser from closed cell foam material.
Figure 6:
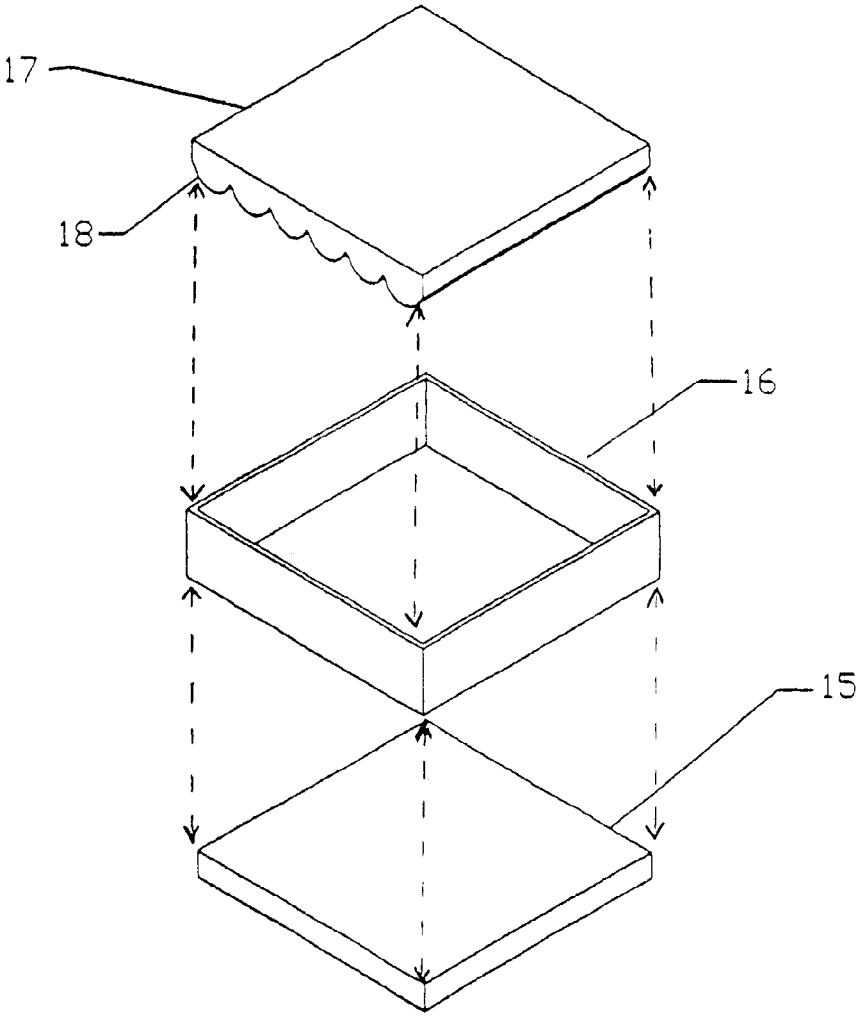
FIG. 6 is an exploded view of the mold shown in FIG. 5.
Figure 7:
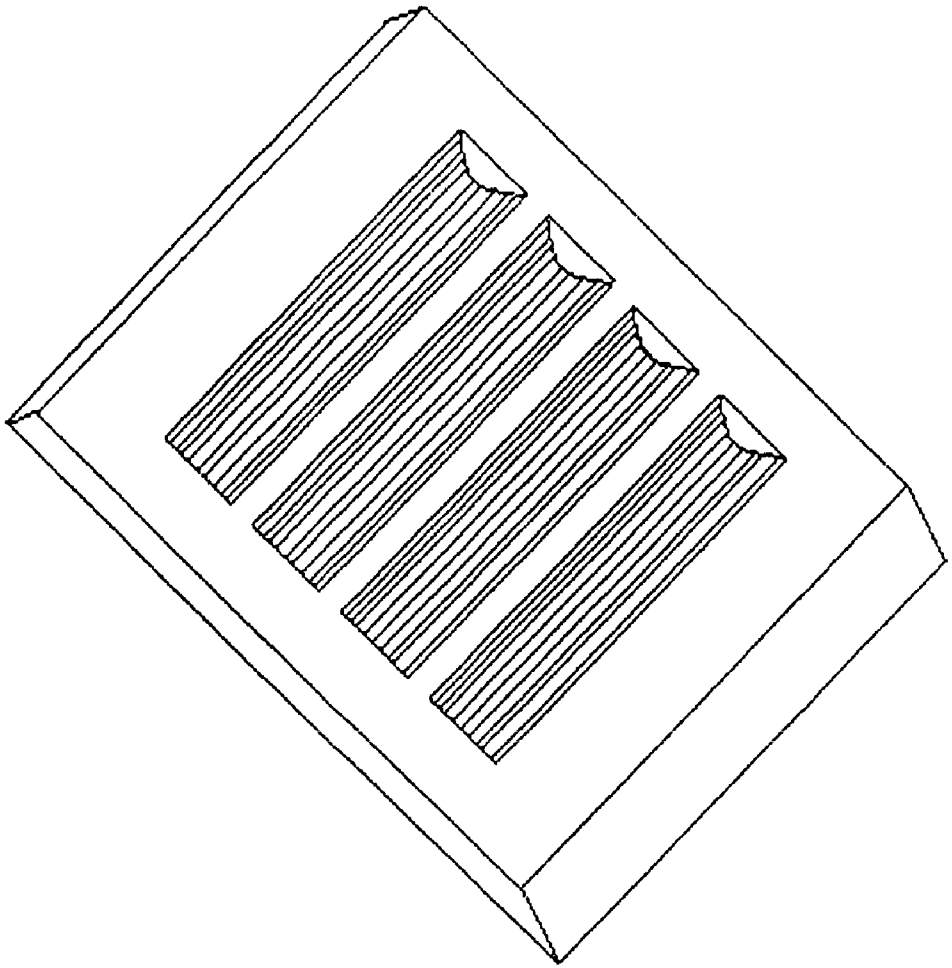
FIG. 7 is a perspective view of an alternative embodiment of a banana riser, angled such that its top, front, and left sides are shown.

Referring to FIGS. 5 and 6, the method of manufacture of banana riser 1 uses a mold 14, which is created from four rectangular side elements 16, a rectangular top element 17, and a rectangular base element 15. In this embodiment, elements 15, 16, 17 are made of metal. The six elements 15, 16, 17 form the sides of a closed container with its sides in connection perpendicularly to each other. The underside of top element 17 includes convex trough pattern 18, such that when closed cell foam material is formed against it, a concave trough pattern results on the top of the resulting solid foam product. An aperture (not shown) is included in mold 14 for inserting closed cell foam material into mold 14.

Banana riser 1 is manufactured using compression molding technology. It is created out of closed cell foam material, such as closed cell pvc foam. A liquid mixture of closed cell foam material is created. The liquid mixture is placed into mold 14 through an aperture in mold 14. The liquid mixture within mold 14 is heated under pressure until the liquid mixture expands and completely fills mold 14 and solidifies. The resulting solid material is removed from mold 14 and cooled. During cooling, the solid material expands to its desired final size.

Among the advantages of banana riser 1 are the following. Banana riser 1 holds produce securely and safely while also providing a visually appealing display. Banana riser's 1 one-piece design simplifies the manufacturing process and increases manufacturing efficiency. The single part design of banana riser 1, coupled with its closed cell foam material construction, reduces the need for multiple parts and provides a surface substantially impervious to water, mold, bacteria, or other organic compounds. The properties of closed cell foam also provide the benefit that, should the surface of banana riser 1 sustain a cut or have a portion broken off, the inner surface of the cut or break will retain the same properties as the unbroken surface. In addition, because the invention is made of a closed cell foam material, it provides greater protection against bruising or damage. That is, if the surface of banana riser 1 is damaged, the underlying material has the same cushioning properties as the surface. Thus, the produce is protected even if banana riser 1 is damaged.

The invention is not limited to what is described in the foregoing embodiments. For example, although a banana riser is described in detail, the principles described herein may be used in the construction and manufacture of any type of stand for displaying produce or any other type of perishable and/or damageable goods.

Other embodiments not specifically set forth herein are also within the scope of the following claims.

What is claimed:

1. A device for displaying produce, comprising: a monolithic, flexible display member constructed entirely of a closed cell foam material, and having a top surface, a bottom surface, a left surface, a right surface, a front surface, and a back surface, with the top surface having a plurality of concave troughs formed into it which support produce, wherein the bottom surface is substantially planar, a plane of the top surface is substantially parallel to the bottom surface, the left surface is substantially parallel to the right surface and adjacent to the top, bottom, front, and back surfaces, the right surface is adjacent to the top, bottom, front, and back surfaces, each trough has a front edge, a back edge, and an inner surface, with the front edge and the back edge of each trough running the length of that trough and each edge being of uniform height, the front edge and the back edge of each trough being substantially parallel to each other for the length of that trough, the inner surface of each trough running from the front edge to the back edge of that trough and being curved generally downward and having a lowest segment located parallel to and between the front edge and the back edge of that trough and running for the length of that trough, and the lowest segment of the inner surface of each trough being of uniform height and of lower height than either the front edge, the back edge, or any other point along the inner surface of that trough, and each trough extends laterally from and through the left surface to and through the right surface for the entire width of the device such that the left surface is formed into scallops where it is adjoined to the top surface and the right surface is formed into scallops where it is adjoined to the top surface.

2. The device of claim 1, wherein each trough comprises at least one of the following characteristics:

each trough is parallel to each other trough, each trough has the same shape and dimensions as each other trough, a straight line distance between the front edge and the back edge of each trough is greater than the difference in height between the front edge and the lowest segment of that trough, and the lowest segment of each trough is equidistant from the front edge and the back edge of that trough.

3. The device of claim 2, wherein the display member has a width of between forty inches and fifty inches as measured from the left surface to the right surface, a depth of between forty inches and fifty-five inches as measured from the front surface to the back surface, and a height of between four inches and six inches as measured from the bottom surface to the highest point of the top surface.

4. The device of claim 3 wherein the straight line distance between the front edge and the back edge of each of the concave troughs is between six inches and ten inches and the difference in height between the front edge and the lowest segment of each of the concave troughs is between one and three quarter inches and three inches.

* * * * *